United States Patent [19]

Hahn

[11] 4,428,131

[45] Jan. 31, 1984

[54] EXCAVATING TOOTH

[75] Inventor: Frederick C. Hahn, Aloha, Oreg.

[73] Assignee: Esco Corporation, Portland, Oreg.

[21] Appl. No.: 372,171

[22] Filed: Apr. 26, 1982

[51] Int. Cl.[3] ..... E02F 9/28

[52] U.S. Cl. ..... 37/142 R; 172/713; 403/334

[58] Field of Search ..... 37/142 R, 142 A, 141 T, 37/141 R; 172/701.3, 719, 718; 403/333, 334, 341

[56] References Cited

U.S. PATENT DOCUMENTS

| | | | |
|---|---|---|---|
| 3,371,436 | 3/1968 | Swanson | 37/142 R |
| 3,601,911 | 8/1971 | Wood | 37/142 R |
| 3,967,399 | 7/1976 | Heihold et al. | 37/142 R X |
| 4,050,172 | 9/1977 | Petersen | 37/142 A |
| 4,136,469 | 1/1979 | Zepf | 37/142 R X |
| 4,233,761 | 11/1980 | Ryerson | 37/142 R |
| 4,326,348 | 4/1982 | Emrich | 37/142 R |

*Primary Examiner*—Edgar S. Burr
*Assistant Examiner*—Moshe I. Cohen
*Attorney, Agent, or Firm*—Tilton, Fallon, Lungmus & Chestnut

[57] ABSTRACT

An excavating tooth including an adapter, a wear cap for the adapter and a point in which the point and adapter have primary cooperating stabilizing surfaces and in which the point and wear cap are equipped with inter-engaging flanges to provide secondary stabilizing surfaces.

8 Claims, 6 Drawing Figures

EXCAVATING TOOTH

BACKGROUND AND SUMMARY OF INVENTION

This invention relates to an excavating tooth and, more particularly, one in which an assembly consisting of a point, adapter and wear cap has a unique stabilizing relationship between the elements so as to resist heavy forces.

As such, it is an improvement upon the co-owned application of Robert K. Emrich, Ser. No. 173,769, filed July 30, 1980, now U.S. Pat. No. 4,326,348. In that case, a unique stabilization was developed between the three elements utilizing side tongues on the wear cap engaging recesses at the point rear sides. Inasmuch as this invention is an improvement thereon, specific reference may be made thereto for details not herein given, and for that purpose, express reference is made thereto.

Although removable points have been used for years to save on throw-away metal when the bit end of the tooth becomes worn and unrepairable, and notwithstanding the fact that wear caps have also been used for a long time to preserve the adapters, it was not until the appearance of the above-identified co-owned application that a unique cooperation was developed between the point and wear cap. The stabilization involved, derives from U.S. Pat. No. 3,079,710 which provided longitudinally spaced apart beam bearing surfaces so as to successfully resist beam forces tending to "wipe" the point off of the adapter. This stabilization is particularly important where the point is relatively short as is the case with huge shovel dippers and drag line buckets.

According to the invention, a novel cooperation is provided between the wear cap and point wherein these two elements function to provide secondary stabilization in the manner of the above-identified application but with different elements. In the preferred embodiment, the wear cap is equipped with a recessed forward edge which mates with a correspondingly contoured recess in the point rear portion and which serve the purpose of secondary stabilization. More particularly, the instant invention has a point wherein the rear portion thereof is equipped with a step to provide a rearwardly-extending integral flange so as to develop two advantages from the single change. First, the point flange in combination with the overlying portion of the wear cap provides secondary stabilization, particularly against the ever-present beam loads tending to "wipe" the point off the adapter. Second, the point flange is positioned in protected relation relative to the projecting forwardly extending flange of the wear cap. This insures that the point flange is not subject to wear and is thereby able to continue the first function throughout its wear life.

The invention is described in conjunction with the accompanying drawing, in which FIG. 1 is a fragmentary perspective view of the tooth embodying teachings of the invention;

DETAILED DESCRIPTION

Figure 1:
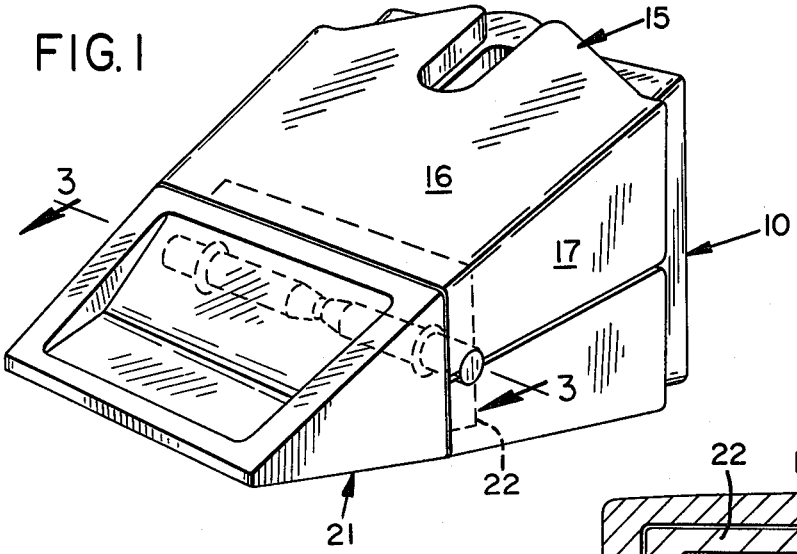
Figure 2:
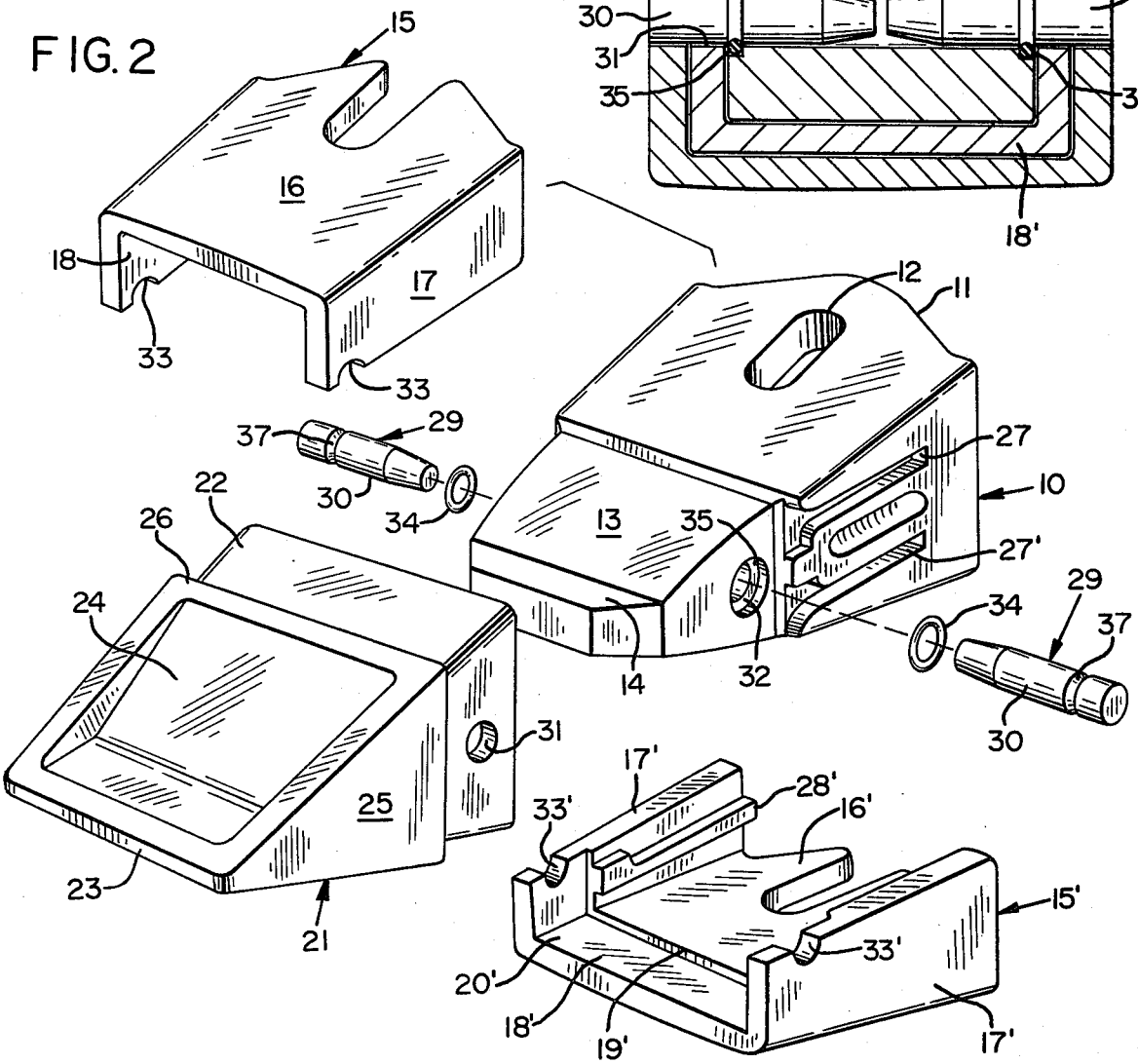
FIG. 2 is an exploded perspective view of the tooth of FIG. 1.

In the illustration given and with reference to FIGS. 1 and 2, the numeral 10 designates generally an adapter. Adapters come in a variety of shank configurations depending upon the type of excavating equipment with which they are used. In any event, adjacent the rear end 11 (see FIG. 2), the adapter is equipped with means in the form of a vertical bore 12 for the receipt of a pin lock for attaching the same to excavating equipment.

At the forward end, the adapter is equipped with nose means 13 which, in the illustrations given, is a generally wedge shaped nose. It will be appreciated that in some instances, the adapter may be equipped with a socket rather than the nose illustrated but the invention principles are equally applicable to both versions. The nose 13 is equipped with primary stabilizing surfaces as at 14 which are provided at the top and bottom in the form taught in U.S. Pat. No. 3,079,710.

The numeral 15 designates generally the wear cap which is normally installed first on the adapter 10. The wear cap 15, in the illustration given, has a top wall 16 and a pair of integral, depending sidewalls 17. The top wall 16 and the sidewalls 17 are extending forwardly to provide an integral forwardly extending flange 18.

This can be best appreciated from a consideration of the lower wear cap generally designated 15′ and which is seen in the lower portion of FIG. 2. Again, this wear cap is equipped with sidewalls 17′ which are interconnected by a cross wall 16′—but because the wear cap 15′ is adapted to be mounted on the underside of the adapter 10, the wall 16′ is more properly termed a bottom wall. It will be appreciated that in the illustration given, the parts of the tooth are symmetrical about a horizontal midplane so that the wear caps 15 and 15′ are interchangeable.

Still referring to the wear cap 15′ in FIG. 2, it will be seen that the extreme forward end is equipped with a flange 18′. This is developed by providing a step as at 19′ in the wall 16′ and 17′ resulting, in effect, in a recess 20′.

Figure 3:
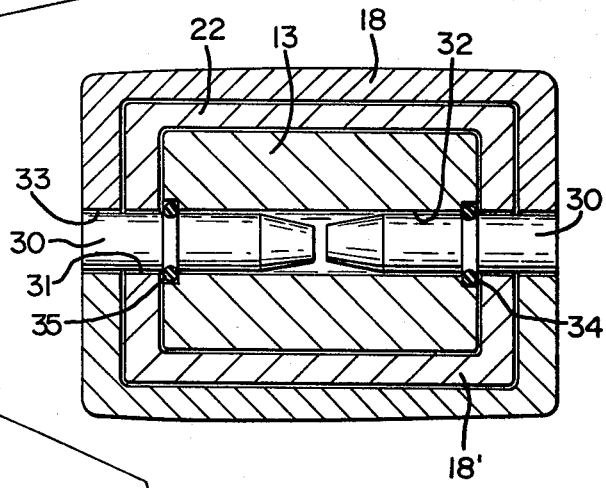
FIG. 3 is a sectional view taken along the line 3—3 of FIG. 1.

For cooperation with the flange 18′, the point generally designated 21 is equipped with a rearwardly extending integral flange as at 22 (compare the showings in FIGS. 2 and 3).

The point 21 is equipped with a bit 23 at the forward edge thereof which is developed by forwardly convergent top and bottom walls 24. The top and bottom walls 24 are integrally connected (as by casting), with sidewalls 25.

More particularly, the walls 24 and 25, in the illustration given, develop a socket (not shown) but which is contoured to receive the nose 13 of the adapter 10. The flange 22 is an integral extension of the walls 24 and 25 and is provided by a step as at 26 so as to develop what could be considered an external recess corresponding to the internal recess 20′ of the wear cap 15′. Also, in the illustration given, the flange 22 is perimetric in a transverse plane so as to cooperate with both the top and bottom wear caps 15 and 15′, respectively.

In the operation of the invention, the wear cap 15, or 15′ or both, is installed by longitudinal movement relative to the already mounted adapter. The adapter is equipped with side slots as at 27 and 27′ (see FIG. 2) which are adapted to receive correspondingly contoured rails on the inside of the wear cap sidewalls 17 and 17'. These are illustrated relative to the wear cap 15' as at 28' in the lower portion of FIG. 2.

Thereafter, the point is installed on the adapter nose 13 by the same type of longitudinal movement and with the flange 22 thereof in protected relation by the flange 18, or 18', or both, as the case may be.

Thereafter a lock means generally designated 29 is installed. The pin lock 29 includes a pair of pins 30 which are adapted to be inserted through aligned openings 31 in the point flange 22 and a horizontally extending opening 32 in the adapter nose 13. The wear cap sidewalls 17, 17' are equipped with semi-cylindrical openings 33 and 33' to accommodate the insertion of the pin locks 30.

Prior to installation of wear caps 15 and 15', point 21 and pin locks 30, locking rings 34 are installed in recesses 35 in the adapter nose sidewalls. It will be noted that the pin locks 30 are equipped with annular grooves as at 37 into which snap the locking rings 34 in the fashion depicted in FIG. 3. It will also be appreciated that the flange 22 serves a dual purpose in not only cooperating with the flanges 18 and 18' but also provide the means via the openings 31 for the installation of the pin locks 30.

Figure 4:
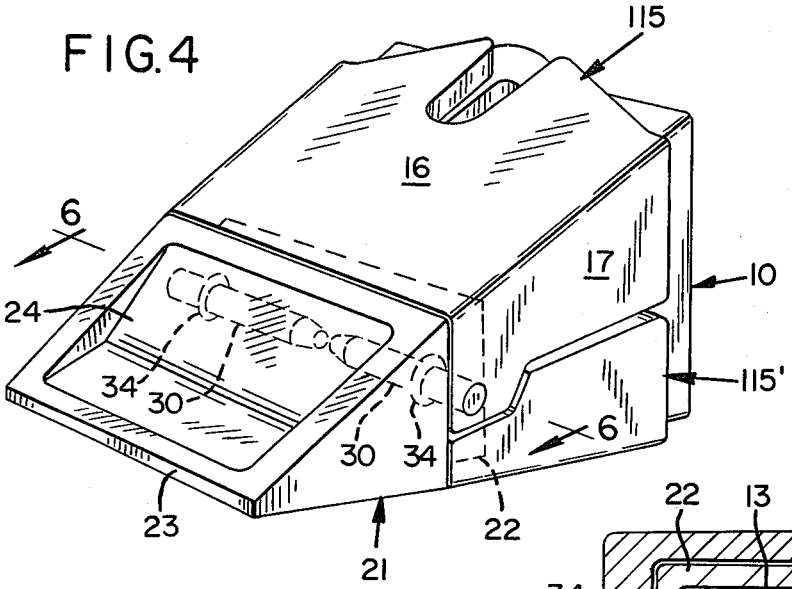
FIG. 4 is a view similar to FIG. 1 but of a modified form of the invention.
Figure 6:
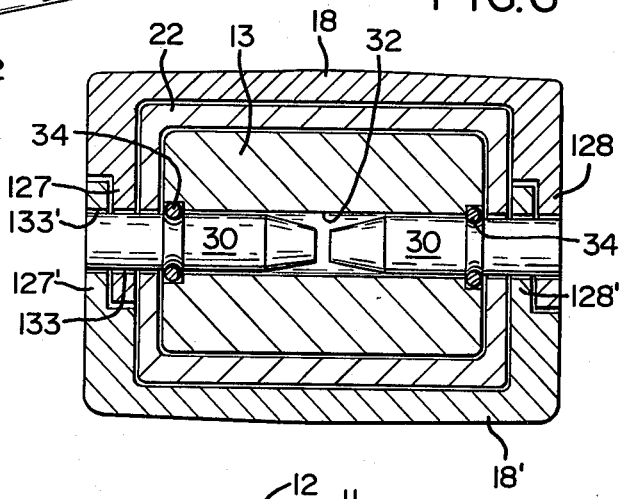
FIG. 6 is a sectional view taken along the sight line 6—6 applied to FIG. 4.
Figure 5:
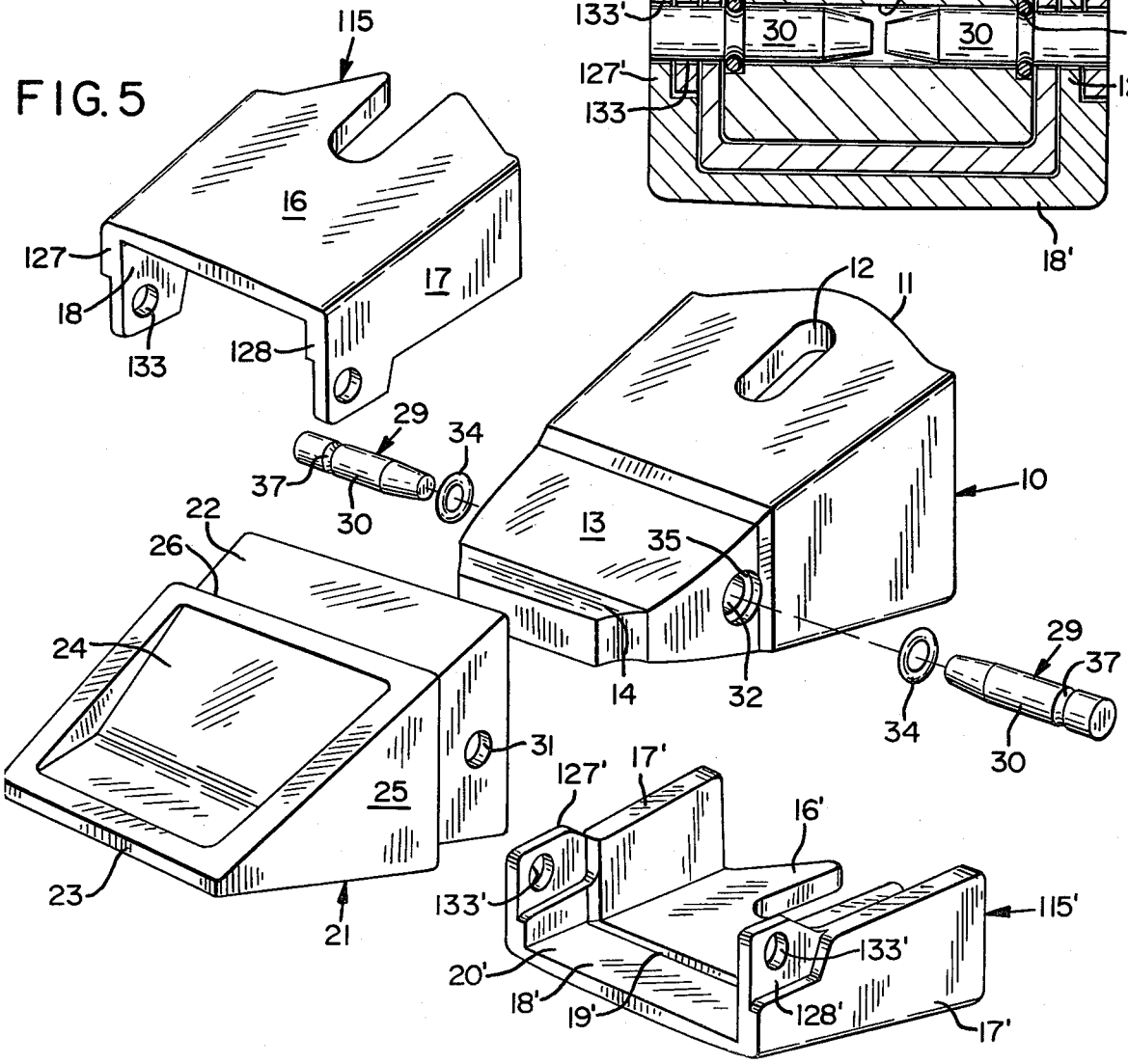
FIG. 5 is an exploded perspective view of the embodiment of FIG. 4.

On the second drawing sheet containing FIGS. 4–6, a modified embodiment of the invention is seen. In this embodiment, like numerals are used for like elements, the essential difference residing in a somewhat different shape and arrangement of the wear caps from those seen in FIGS. 1–3. The difference in a wear cap can be best appreciated from a comparison of the lower wear cap 115' of FIG. 5 with the wear cap 15' of FIG. 2. An important difference resides in the provision of the stepped sidewalls as at 127' and 128' (alternatively 127 and 128 relative the upper wear cap 115). Through the use of this construction, I am enabled to eliminate the side slots 27, 27' and contoured rails 28, 28' of the first described embodiment. However, these may be added in the embodiment of FIGS. 4–6 and thereby reduce the size of the locking pin 29 which is required. The operation of the two embodiments is essentially the same. An essential difference resides in the fact that the pins 30 now extend through the aligned openings 133 and 133' in the stepped sidewalls 127, 127', 128 and 128' in the fashion indicated in FIG. 6. It will also be noted that the wear caps are identical so that they can be reversed.

While in the foregoing specifications, a detailed description of the invention has been set down for the purpose of illustration, many variations in the details hereingiven may be made by those skilled in the art without departing from the spirit and scope of the invention.

I claim:

1. A tooth assembly for earth working equipment comprising an adapter having top, bottom and side surfaces and means at the rear end thereof for projecting the same forwardly from said equipment and point coupling means at the forward end for receiving a point attachable on said adapter by movement along a predetermined axis, said point coupling means terminating in a pair of spaced apart stabilizing surfaces arranged on opposite sides of said axis, a wear cap removably mounted on said adapter covering at least a portion of said top surface, said wear cap having an internal step at the forward end thereof providing a forwardly extending integral flange, a point removably coupled to said adapter and having a bit at the forward end thereof and the complement to said coupling means at the rear end thereof, said complement to said coupling means terminating in a pair of spaced apart stabilizing surfaces arranged on opposite sides of said axis, said point having an external step at the rear end thereof providing a rearwardly extending integral flange adapted to underlie said wear cap forwardly extending flange whereby said flanges cooperate with said stabilizing surfaces in resisting the beam component of externally applied forces on said point, and lock means releasably securing said point to said adapter, said wear cap having a top and sidewalls, said wear cap flange extending forwardly from all of said walls, said point having a top and sidewalls, said point flange extending rearwardly from all of said point walls.

2. The structure of claim 1 in which said point is equipped with a bottom wall with said point flange extending rearwardly from said bottom wall also whereby said point is adapted to cooperate with wear caps on both the top and bottom of said adapter.

3. The structure of claim 1 in which said point is equipped with a socket constituting said coupling means, said point flange being equipped with aligned openings in the portions thereof extending rearwardly from said point sidewalls to accommodate a pin lock constituting said lock means.

4. The structure of claim 3 in which said wear cap has a internal rail means for cooperation with slot means on said adapter for mounting said wear cap on said adapter.

5. The structure of claim 4 in which said wear cap is equipped with partial recesses for accommodating the insertion of said lock means.

6. The structure of claim 1 in which said wear cap has aligned openings in the sidewalls thereof adjacent said internal step for the receipt of said lock means.

7. The structure of claim 6 in which said wear cap at the forward end thereof adjacent said internal step is equipped with a horizontal shoulder in each sidewall for cooperation with a similar shoulder in a second wear cap installed on said adapter.

8. A tooth assembly for earth working equipment comprising a relatively elongated adapter having top, bottom and side surfaces and means at the rear end thereof for attachment to said equipment and nose means at the forward end for receiving a point attachable on said adapter by movement along a longitudinal axis, said nose means terminating in spaced apart top and bottom stabilizing surfaces arranged on opposite sides of said axis, said adapter also having side slots for supporting a wear cap on said top surface to protect said adapter against wear from earth passing thereover, a generally U-shaped wear cap removably mounted on said adapter covering at least a portion of said top surface and having inwardly extending side rails engaging said adapter slots, said wear cap having an internal recess forming a perimetric flange adjacent the forward end thereof, a relatively elongated point removably mounted on said nose means having a bit at the forward end thereof and the complement to said nose means at the rear end thereof, said complement to said nose means terminating in a pair of spaced apart stabilizing surfaces arranged on opposite sides of said axis, said point having forwarding convergent top and bottom walls and generally vertically extending sidewalls, said point adjacent the rear end thereof having an external recess mating with said wear cap recess whereby recesses cooperate with said stabilizing surfaces and reacting to beam forces on said point, and lock means releasably securing said point to said adapter.

* * * * *